US011168630B2

(12) United States Patent
Dahlgren et al.

(10) Patent No.: US 11,168,630 B2
(45) Date of Patent: Nov. 9, 2021

(54) PRECONDITIONING METHOD FOR A PARTICULATE FILTER

(71) Applicant: Volvo Car Corporation, Gothenburg (SE)

(72) Inventors: Jan Dahlgren, Torslanda (SE); Stefan Dunert, Särö (SE); Mattias Nilsson, Onsala (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

(21) Appl. No.: 17/026,382

(22) Filed: Sep. 21, 2020

(65) Prior Publication Data

US 2021/0115865 A1 Apr. 22, 2021

(30) Foreign Application Priority Data

Oct. 16, 2019 (EP) ..... 19203618

(51) Int. Cl.

*F02D 41/02* (2006.01)
*F02D 41/14* (2006.01)
*F01N 9/00* (2006.01)

(52) U.S. Cl.

CPC ..... *F02D 41/029* (2013.01); *F02D 41/1445* (2013.01); *F02D 41/1448* (2013.01); *F01N 9/005* (2013.01); *F01N 2550/04* (2013.01); *F01N 2560/08* (2013.01); *F01N 2900/1406* (2013.01); *F01N 2900/1606* (2013.01)

(58) Field of Classification Search

None

See application file for complete search history.

(56) References Cited

U.S. PATENT DOCUMENTS 8,612,115 B2 * 12/2013 George ..... F02D 41/0235 701/102
8,646,257 B2 * 2/2014 Svensson ..... F01N 9/002 60/295
8,713,913 B2 * 5/2014 Wenninger ..... F02D 41/0235 60/274
8,943,803 B2 * 2/2015 Pipis, Jr. ..... F02D 41/025 60/285

(Continued)

FOREIGN PATENT DOCUMENTS

DE 102011077097 A1 12/2012
EP 3040531 A1 7/2016

(Continued)

OTHER PUBLICATIONS

Feb. 12, 2020 European Search Report issued on International Application No. 19203618.

*Primary Examiner* — Kevin R Steckbauer

(74) *Attorney, Agent, or Firm* — Clements Bernard Walker; Christopher L. Bernard

(57) ABSTRACT

An improved method for performing a conditioning process for a particulate filter, preferably adapted for an aftertreatment system arranged downstream of an internal combustion engine. The proposed method provides for conditioning of a filter under controlled conditions such that the filter may reach a desired operation state in a more efficient and faster manner. Further, the proposed method also advantageously provides for maintaining the desired operation state, in which the filtration capacity may be at a usable level.

15 Claims, 4 Drawing Sheets

(56) References Cited

U.S. PATENT DOCUMENTS

| | | | | |
|---|---|---|---|---|
| 9,599,051 | B2 * | 3/2017 | Lundstedt | F02D 41/027 |
| 9,719,399 | B2 * | 8/2017 | Odendall | F01N 11/002 |
| 10,059,338 | B2 * | 8/2018 | Leisenring | F02D 41/029 |
| 10,273,858 | B2 * | 4/2019 | Hall | F01N 9/002 |
| 10,598,069 | B2 * | 3/2020 | Leisenring | F02D 41/027 |
| 10,781,739 | B2 * | 9/2020 | Hall | F01N 3/021 |
| 10,794,309 | B2 * | 10/2020 | Ruhland | B01D 53/94 |
| 10,865,676 | B1 * | 12/2020 | Szczepanski | F01N 3/023 |
| 11,035,281 | B2 * | 6/2021 | Srinivasan | F01N 13/00 |
| 2005/0086933 | A1 | 4/2005 | Nieuwstadt et al. | |
| 2008/0034738 | A1 * | 2/2008 | Singh | F01N 13/009 60/295 |
| 2010/0126145 | A1 * | 5/2010 | He | F01N 9/002 60/286 |
| 2010/0242449 | A1 * | 9/2010 | Paterson | F01N 9/002 60/286 |
| 2011/0162352 | A1 * | 7/2011 | Svensson | F01N 9/002 60/297 |
| 2012/0102920 | A1 * | 5/2012 | Pipis, Jr. | F01N 3/103 60/274 |
| 2013/0074476 | A1 * | 3/2013 | Wenninger | F01N 3/021 60/274 |
| 2015/0020504 | A1 * | 1/2015 | Nicole | F01N 13/008 60/274 |
| 2015/0285173 | A1 * | 10/2015 | Lundstedt | F02D 41/0285 701/102 |
| 2016/0186636 | A1 * | 6/2016 | Odendall | F01N 11/002 60/273 |
| 2017/0158194 | A1 * | 6/2017 | Leisenring | F01N 3/025 |
| 2019/0001974 | A1 * | 1/2019 | Leisenring | F01N 3/025 |
| 2019/0112994 | A1 * | 4/2019 | Ruhland | F02D 41/0235 |
| 2020/0378293 | A1 * | 12/2020 | Liu | F01N 9/002 |
| 2021/0003060 | A1 * | 1/2021 | Srinivasan | F01N 9/00 |
| 2021/0189941 | A1 * | 6/2021 | Riechert | F01N 3/30 |

FOREIGN PATENT DOCUMENTS

| | | | |
|---|---|---|---|
| FR | 2829798 | A1 | 3/2003 |
| WO | 2012030278 | A1 | 3/2012 |
| WO | 20170201171 | A1 | 11/2017 |

* cited by examiner

PRECONDITIONING METHOD FOR A PARTICULATE FILTER

CROSS-REFERENCE TO RELATED APPLICATION

The present disclosure claims the benefit of priority of co-pending European Patent Application No. 19203618.4, filed on Oct. 16, 2019, and entitled "AN IMPROVED PRECONDITIONING METHOD FOR A PARTICULATE FILTER," the contents of which are incorporated in full by reference herein.

TECHNICAL FIELD

The present disclosure relates to a method for performing a conditioning process for a particulate filter for an aftertreatment system.

BACKGROUND

With increasing emissions requirements for particulates in the emission from vehicles and other combustion sources, particulate filters have been introduced. Particulate filters are designed to remove particulates, so-called soot, from the exhaust gas before the exhaust gas is emitted into the environment. The particulates are stored in the filter.

The filters have different filtration capacity depending on the level of particulates stored in the filter. A new clean filter has relatively low filtration capacity due to the lack of particulates in the filter. When the particulate level in the filter increases the filtration capacity also improves.

However, increasing particulate level also increases the backpressure across the filter and an excessive backpressure leads to exhaust passage blocking and ultimately to engine malfunction. Most modern filters are adapted to be regenerated or cleaned by controlling the combustion process. However, as with a new filter, a regenerated filter also has initial reduced filtration capacity.

SUMMARY

The present disclosure generally relates to an improved method for performing a conditioning process for a particulate filter, preferably adapted for an aftertreatment system arranged downstream of an internal combustion engine.

The proposed method provides for conditioning of a filter under controlled conditions such that the filter may reach a desired operation state in a more efficient and faster manner. Further, the proposed method also advantageously provides for maintaining the desired operation state, in which the filtration capacity may be kept at a usable level.

For conditioning the filter, at least one combustion control parameter of the internal combustion engine is controlled to increase a present exhaust mass flow of combustion particulates into the filter. In this way, the filter may receive an increasing number of particulates that it can store to thereby improve the filtration capacity. However, in order to quickly reach and maintain the operable state and ensuring a stable operation of the filter during conditioning, for example to not overshoot the number of particulates stored in the filter, at least one condition for the filter is controlled.

The exhaust mass flow is increased to levels that are near maximum levels on a start of injection versus particle number diagram.

The above advantages are provided by acquiring a parameter indicative of a pressure drop across the filter, and controlling at least one combustion control parameter of the internal combustion engine to control the pressure drop across the filter to maintain a pressure deviation between a normalized pressure drop formed from the acquired parameter relative a predetermined normalization pressure level for a model filter, and a predetermined pressure drop value, below a predetermined pressure deviation.

The normalized pressure drop may be normalized relative a predetermined normalization pressure level at a predetermined temperature for a model filter.

The pressure drop across the filter is related to the amount of particles stored in the filter. Thus, measuring the pressure drop may provide a hint of the amount of particles in the filter. However, the pressure drop across the filter also depends on the temperature in the filter which may lead to an inaccurate determination of the amount of particles in the filter. Further, the amount of particulates in the filter is related to some degree to the temperature of the filter, the pressure across the filter, and the flow of particulates in the exhaust gas. Therefore, by normalizing the measured pressure drop to a predetermined level for a specific temperature, the influence of the temperature on the pressure drop evaluation is at least partly reduced, leading to a more stable conditioning process.

With the herein disclosed method, the filter may receive a sufficient number of particulates for conditioning in a short period of time while at the same time ensuring a stable operation of the filter during conditioning. The method may be performed during reconditioning of a filter. The method may be performed during conditioning of a new filter. The method may be performed for maintaining the filter in an desired filter capacity operation window.

Further features of, and advantages with, the embodiments of the present disclosure will become apparent when studying the appended claims and the following description. The skilled person realize that different features of the present disclosure may be combined to create embodiments other than those described in the following, without departing from the scope of the present disclosure.

BRIEF DESCRIPTION OF THE DRAWINGS

These and other aspects of the present disclosure will now be described in more detail, with reference to the appended drawings showing example embodiments of the present disclosure, wherein.

DETAILED DESCRIPTION

Figure 1:
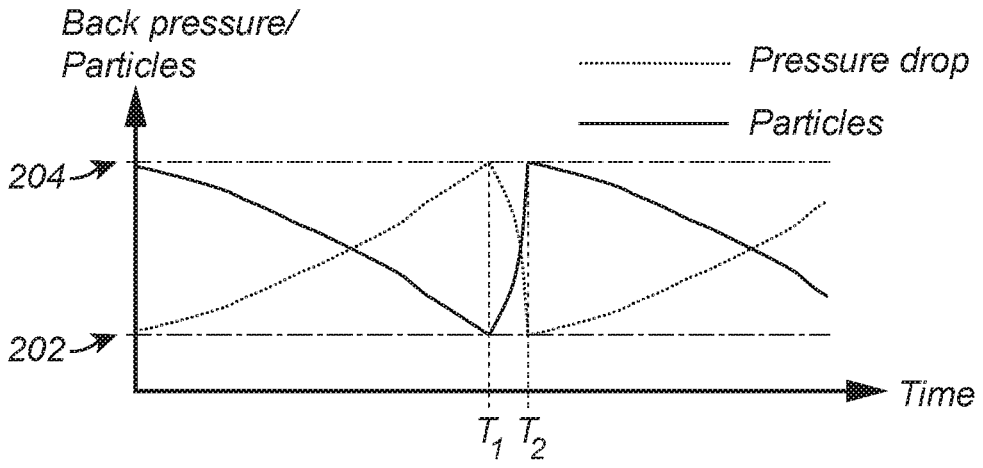
FIG. 1 schematically illustrates a general regeneration cycle of a combustion engine particulate filter for a prior art vehicle aftertreatment system.

In the present detailed description, various embodiments of a conditioning method and filter assembly according to the present disclosure are described. However, the method and filter assembly may be embodied in many different forms and should not be construed as limited to the embodiments set forth herein; rather, these embodiments are provided for thoroughness and completeness, and to fully convey the scope of the disclosure to the skilled person. In some instances, well known structures and devices are shown in block diagram form in order to avoid obscuring the novelty of the exemplary embodiments presented herein. Like reference characters refer to like elements throughout.

Generally, filter efficiency depends on the amount of soot load in the filter. A large amount of soot (i.e. particles caught by the filter) in the filter results in higher efficiency in filtering (i.e. a low amount of particulates in the emitted filtered gas flow) but also to a high back pressure. An excessive back pressure leads to that no or very little gas flow will be able to pass through the filter and therefore also to combustion engine malfunction. As the back pressure increases, a so-called regeneration is often performed in order to reduce the soot load in the filter and consequently reduce the back pressure across the filter.

FIG. 1 illustrates a regeneration cycle of a combustion engine particulate filter for a prior art vehicle aftertreatment system. Initially, the filter is relatively clean and the pressure drop is low and the emitted flow of particulates from the filter is relatively high. Up until time T1 in the graph, a build-up in soot load in the filter occurs and the emitted flow of particulates from the filter is consequently reduced to reach a minimum at time T1. During the same time period, up to time T1 in FIG. 1, the pressure drop across the filter (i.e. the backpressure) is increasing to reach a maximum at time T1. At T1, a regeneration process is performed which reduces the soot load in the filter and consequently increases the emitted flow of particulates from the filter. Further, the regeneration also causes a reduction of the back pressure in the filter and the cycle starts over at time T2. The lines 202 and 204 indicate the boundaries for filter operation window.

The inventors realized that during a conditioning process, it will be difficult to reach and maintain a desired level of particulates in the filter with such large filter operation window as allowed in prior art systems. Thus, the inventors realized that by controlling the filter conditions during conditioning a narrower filter operation window may be obtained that provides for a more stable conditioning process, and for reaching a suitable operation state for the filter faster.

Figure 2:
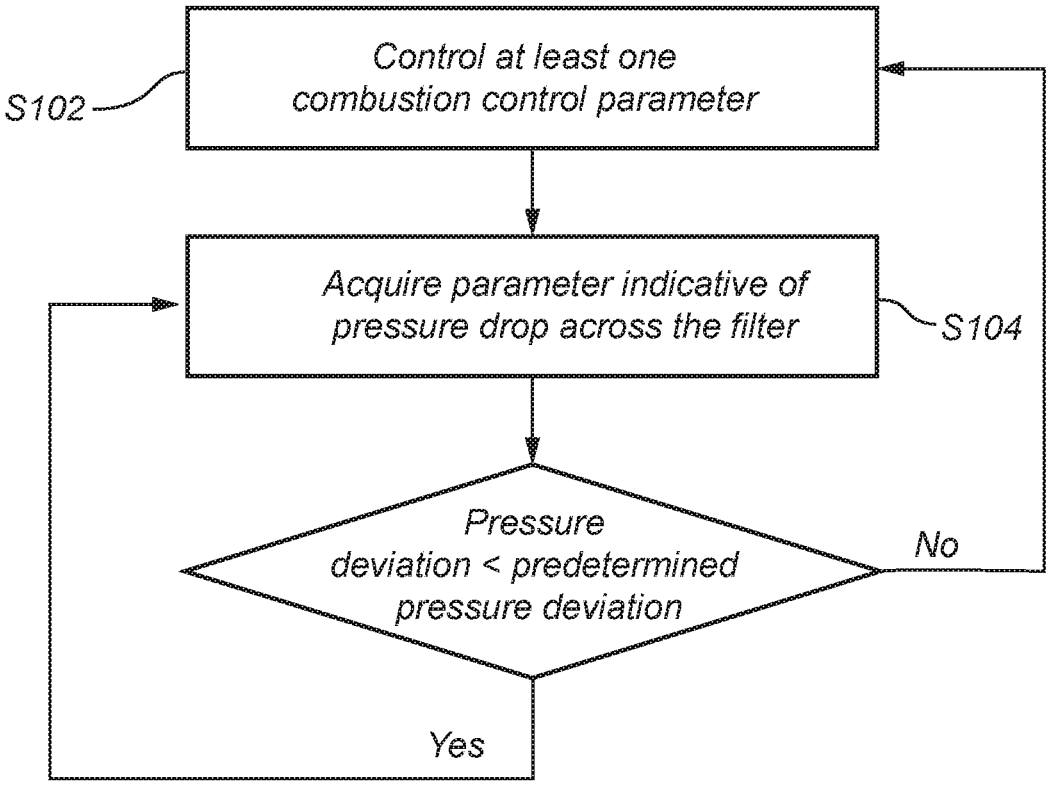
FIG. 2 is a flow-chart of method steps according to embodiments of the present disclosure.

FIG. 2 is a flow-chart of method steps according to embodiments of the present disclosure. In step S102, controlling at least one combustion control parameter of the internal combustion engine, to increase a present exhaust mass flow of combustion particulates into the filter. In step S104, acquiring a parameter indicative of a pressure drop across the filter. Further, when a pressure deviation between a normalized pressure drop formed from the acquired parameter relative a predetermined normalization pressure level for a model filter, and a predetermined pressure drop value, exceeds a predetermined pressure deviation, controlling S102 at least one combustion control parameter of the internal combustion engine to control the pressure drop across the filter to maintain the pressure deviation below the predetermined pressure deviation. If the pressure deviation does not exceed the predetermined pressure deviation, a further parameter indicative of the pressure drop is acquired in step S104.

The predetermined pressure drop value may be calculated based on a pressure drop model including a relation between pressure drop and exhaust mass flow for a model filter. As long as the pressure deviation is below the predetermined pressure deviation the pressure drop is repetitively measured to acquire a parameter indicative of the pressure drop in step S104. However, if the pressure deviation exceeds the predetermined pressure deviation, the combustion control parameter is again controlled in such a way to decrease pressure deviation in step S102. Controlling the combustion parameter to maintain the pressure deviation below the predetermined pressure deviation may include to control the temperature in the filter such that to burn soot in the filter and thereby decrease the pressure drop across the filter, by e.g. increasing the exhaust gas temperature. This may be achieved by controlling e.g. a fuel injection unit to inject fuel into the combustion chamber upstream the filter, or to vary the air/fuel ratio in the combustion engine. It may be the start position of fuel injection into the combustion chamber upstream the filter that is controlled.

Preferably, the combustion control parameter is controlled to increase a present flow of exhaust mass flow of combustion particulates into the filter while at the same time reducing the pressure deviation. Example combustion control parameters include at least one of the start positioning of the injection of the internal combustion engine and the air/fuel ratio for the internal combustion engine.

Figure 3:
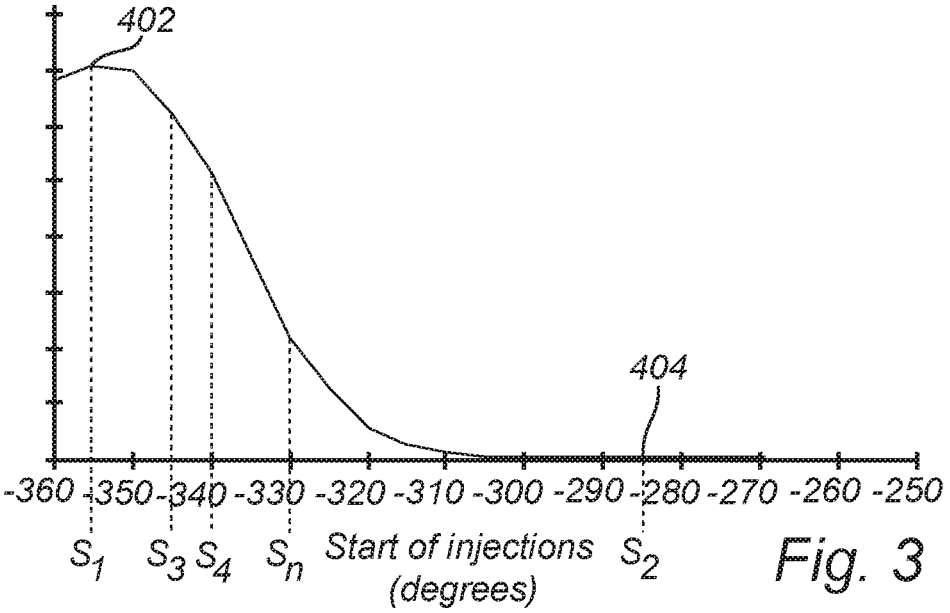
FIG. 3 is an example start of injection diagram.

FIG. 3 illustrates an example diagram including the start of injection represented by the crank shaft angle. The angles on the start of injection axis are only shown for example purposes and the specific angles may depend on the specific engine design and configuration. Initially, according to the present disclosure, the start positioning S1 of the injection of the internal combustion engine may be set such that the exhaust mass flow of combustion particulates into the filter is increased to a relatively high level, 402, compared to the relatively low level 404 provided with a more delayed start positioning S2 of the injection of the internal combustion engine, compared to position S1. The present exhaust mass flow of combustion particulates into the filter at position S1, as controlled via the combustion control parameter may be near or at a maximum level 402 of particulate number on the start of injection diagram shown in FIG. 3. After several engine revolutions with the high level 402 of particulates, the start positioning may be shifted from S1 to intermediate positions, S3-Sn between S1 and S2 to in this way maintain a pressure deviation between a normalized pressure drop relative a predetermined normalization pressure level for a model filter and a predetermined pressure drop value, below a predetermined pressure deviation. The air/fuel ration may also be adjusted in order to maintain the pressure deviation below the predetermined pressure deviation during the conditioning process for the filter. The ratio of the density of particulates in the exhaust gas flow at position S1 compared to at position S2 may be in the order of hundreds, e.g. the number of particles generated at position S1 may be 100, 200, 300, 400, 500, 600, 700, 800, or even 900, times higher than at position S2.

Figure 4:
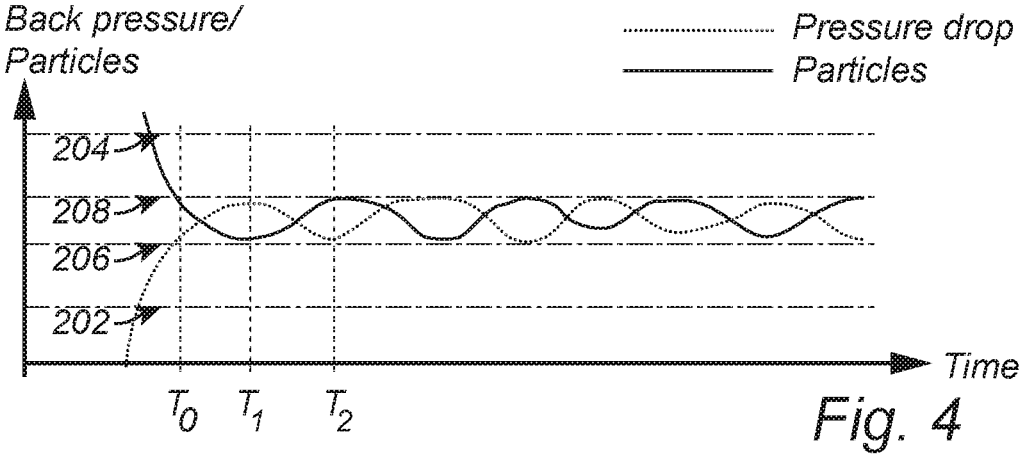
FIG. 4 schematically illustrates an improved regeneration cycle for combustion engine particulate filters.

FIG. 4 illustrates a regeneration cycles as in FIG. 1, but in FIG. 3 a cycle is performed in accordance with herein disclosed methods that are used also for preconditioning of a filter. The method is particularly advantageous for clean, unused filters. As is illustrated, the indicated boundaries 206 and 208 which show a filter operating window is substantially reduced compared to the prior art filter efficiency window illustrated by boundaries 202 and 204. This is due to the active filter control provided by the embodiments of the present disclosure which provides for efficient preconditioning, i.e. to reach a pressure drop across the filter within the operating window, and maintain it within the narrower window. Before time T0, the combustion control parameter has been controlled to increase the amount of particulates in the filter to a level near a maximum level. However, since the filter is clean, the amount of particles in the emitted gas flow I relatively high, and the pressure drop across the filter is low. Thus, the conditioning process for an unused filter may be performed until time T0 to reach the operation window, whereby reconditioning is performed subsequently in order to maintain the filter state within the operation window.

Accordingly, as the pressure drop has increased to a maximum at T1 and the amount of particles in the emitted gas flow is at a minimum, the regeneration of the filter is performed sooner than in prior art systems. At time T2 is the pressure drop again at a local minimum and the amount of particles in the emitted gas flow at a local maximum. However, in order to be able to control the cycle as shown in FIG. 4, the pressure drop must be measured and controlled in a well-defined way that is consistent between measurements, as will be described next. Using the active filter control enables such narrow filter operation window during conditioning, i.e. while actively providing an increased number of particulates, i.e. a boost in particle density.

Figure 5:
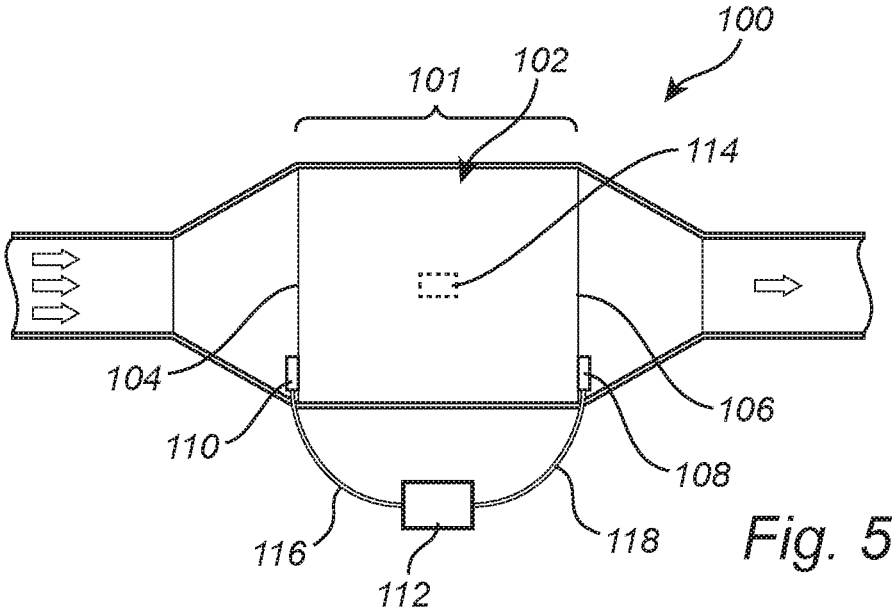
FIG. 5 conceptually illustrates exemplary filter assembly according to embodiments of the present disclosure.

FIG. 5 conceptually illustrates an exemplary filter assembly 100 for an exhaust aftertreatment system according to embodiments. The filter assembly 100 comprises a particulate filter 100 for an aftertreatment system arranged to receive exhaust gas from an internal combustion engine. The filter 101 having an inflow area 104 for receiving an exhaust gas flow, and an outflow area 106 for emitting a filtered gas flow. The filter 101 further comprises a filtering area 102 between the inflow area 104 and the outflow area 106 configured to filter the exhaust gas from particulates. Thus, the exhaust gas flow entering the filter 101 at the inflow area 104 is filtered in the filtering area 102 and the resulting filtered gas flow is emitted at the outflow area 106. The filtered gas flow comprises a lower density of particulates compared to the exhaust gas entering the filtering area 102.

A pressure drop across the filter 101 is measurable by a pressure sensor assembly comprising a set of sensors 108, 110, and a measuring unit 112 which is configured to measure the pressure drop across the filter 101. The pressure drop may be measured as a pressure difference between the inflow area 104 and the outflow area 106. In some embodiments, the connection lines 116, 118 between the outlets of sensors 108, 110, and the measuring unit 112 are of substantially equal length and cross-sectional area in order to avoid phase differences between the sensed pressure upstream and downstream of the filter 101. In this embodiment only one measuring unit is shown, however, in some possible implementations one measuring unit for the inflow area and another measuring unit for the outflow area is comprised in the system 100.

The assembly 100 further comprises a temperature sensor 114 (conceptually shown), for measuring a temperature of the filter 101 in the filtering area 102. The temperature sensor may provide temperature data to a vehicle control unit (not shown in FIG. 1) and may be used as a reference for alternating the temperature in the filter.

At least one combustion control parameter of the internal combustion engine is controllable to cause an increase in a flow of exhaust mass flow of combustion particulates into the filter. Example combustion control parameters include at least one of the start positioning of the injection of the internal combustion engine and the air/fuel ratio for the internal combustion engine.

Adjusting the start positioning of the injection of the internal combustion engine and the air/fuel ratio for the internal combustion engine may generally cause an increase in the temperature in the filter for performing filter regeneration, i.e. to burn soot in the filter.

The combustion control parameter is controllable to maintain a pressure deviation between a normalized pressure drop relative a predetermined normalization pressure level for a model filter and a predetermined pressure drop value, below a predetermined pressure deviation.

Figure 6:
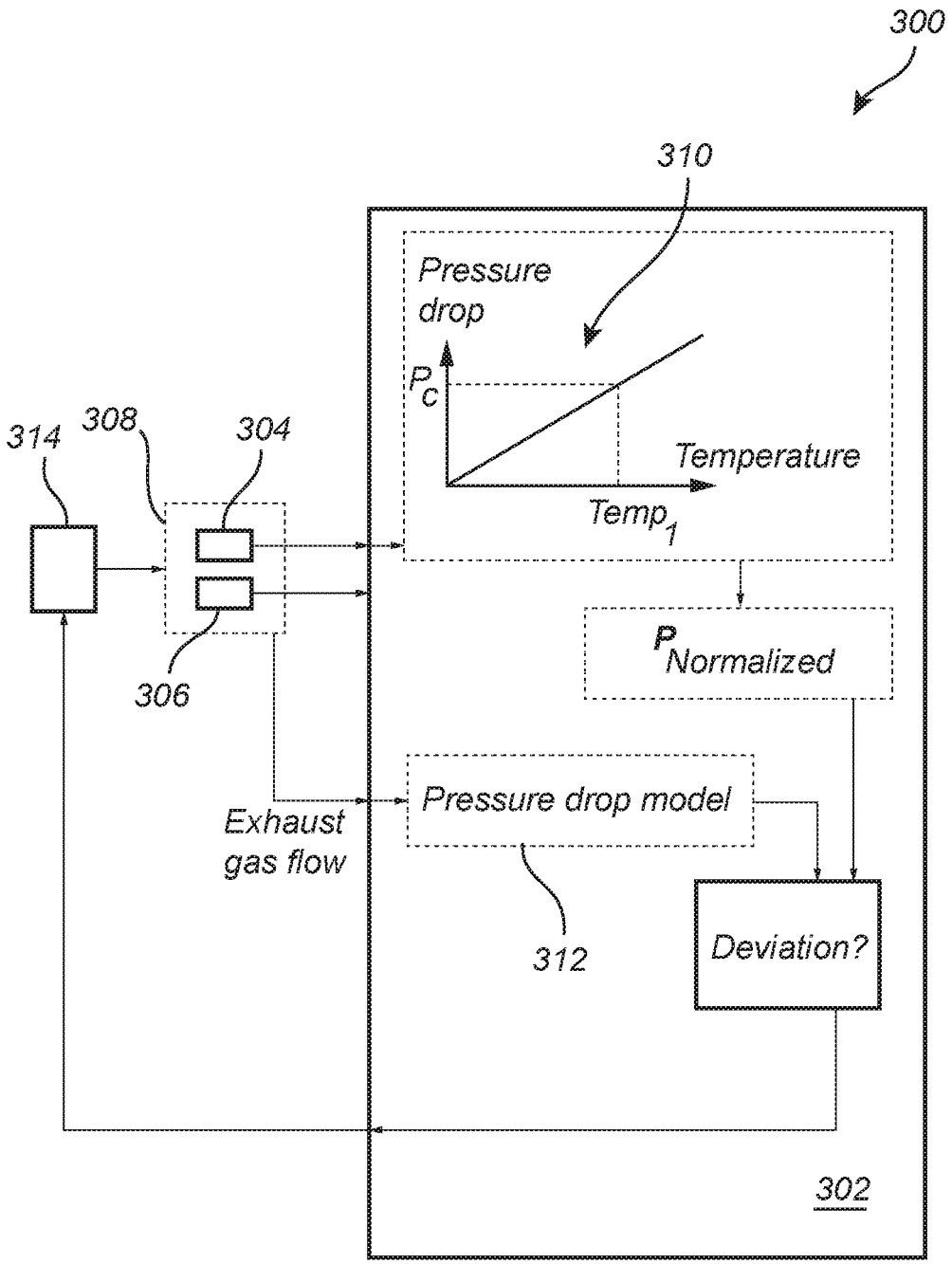
FIG. 6 is a box diagram of a filter assembly for an exhaust aftertreatment system according to an example embodiment of the present disclosure.

FIG. 6 illustrates a box diagram of a filter assembly 300 for an exhaust aftertreatment system according to an example embodiment. The filter assembly 300 comprises a control unit 302 arranged to receive pressure data from a pressure sensor assembly 304 and temperature data from a temperature sensor 306. The pressure data is indicative of the pressure drop across a filter 308, and the temperature data is indicative of the temperature of the filter 308, the filter is only schematically illustrated as a dashed box 308. The following steps are described for preconditioning of a filter, preferably a clean filter to be preconditioned.

Accordingly, the control unit 302 controls at least one combustion control parameter of the internal combustion engine, in such a way that a present exhaust mass flow of combustion particulates into the filter is increased. Further, the control unit 302 determines the pressure drop across the filter 308 and normalizes the determined pressure drop relative a pressure $P_C$ at a predetermined temperature Temp 1 determined for a model filter. The normalized pressure is given by $P_{Normalized}=P_{Measured}/P_C$. The model filter is preferably representative of a clean filter with a relatively linear pressure drop versus temperature curve 310. The normalized pressure $P_{Normalized}$ is subsequently compared to a pressure drop model 312 which comprises a relation between pressure drop (P) across the filter and exhaust gas flow ($\dot{m}_{exhaust}$) to the filter 308. The pressure drop model may be given on the general form:

$$P=A+K_1\dot{m}_{exhaust}+K_2\dot{m}_{exhaust}^2+\ldots K_n\dot{m}_{exhaust}^n$$

where A and $K_1$-$K_n$ are constants. This pressure drop model is based on the pressure drop across a clean model filter. The normalized pressure drop may be compared to the above pressure drop model since the temperature dependence in the measured pressure has been eliminated by the normalization.

Although any order of the above pressure drop model 312 may be used, in some embodiments the simplified form:

$$P=A+K_1\dot{m}_{exhaust}$$

is used as a pressure drop model 312.

Inserting the measured exhaust gas flow in to the model 312 provides a calculated pressure drop value. A comparison between the calculated pressure drop and the normalized pressure drop may result in a deviation between the normalized pressure drop ($P_{Normalized}$) and a pressure drop value calculated based on the pressure drop model 312.

The control unit 302 subsequently controls a fuel injection unit 314 to inject fuel into the combustion chamber upstream the filter 308, or to vary the air/fuel ratio in the combustion engine in order to increase the temperature in the filter to burn soot in the filter and thereby decrease the pressure drop across the filter 308. For example, injection control to the combustion engine may comprise to adjust the fuel injection start time to the cylinder of the engine connected to the aftertreatment system. Next, the process described with reference to FIG. 3 is initiated again in order to provide for active control of the pressure drop across the filter 308 and thereby also the filter efficiency during pre-conditioning. Thus, the steps are repeated at a repetition rate for quickly reaching the desirable filter efficiency during pre-conditioning. Such repetition rate may for example be related to, or even synchronized with, the revolution per minute of the combustion engine. In some possible implementations the repetition rate may be related to the repetition rate for performing a lambda coefficient measurement of the exhaust gas in the aftertreatment system.

The determined exhaust gas flow may be received from a vehicle control unit performing such calculation. For example, the calculation may be based on the present air intake and fuel intake to the engine connected to the aftertreatment system, and the present operating speed of the engine (e.g. revolutions per minute). Thus, the present exhaust mass flow may be either retrieved (e.g. an exhaust mass flow value is retrieved) from a control unit or calculated by a control unit controlling the inventive method.

The temperature data may be used for controlling the pressure across the filter which often performed by increasing the temperature of the exhaust gas to thereby burn the particulates in the filter. Thus, cause a variation of the pressure drop across the filter for reducing the pressure deviation includes to increase the temperature of the filter, the temperature being determined by the temperature sensor 306.

Figure 7:
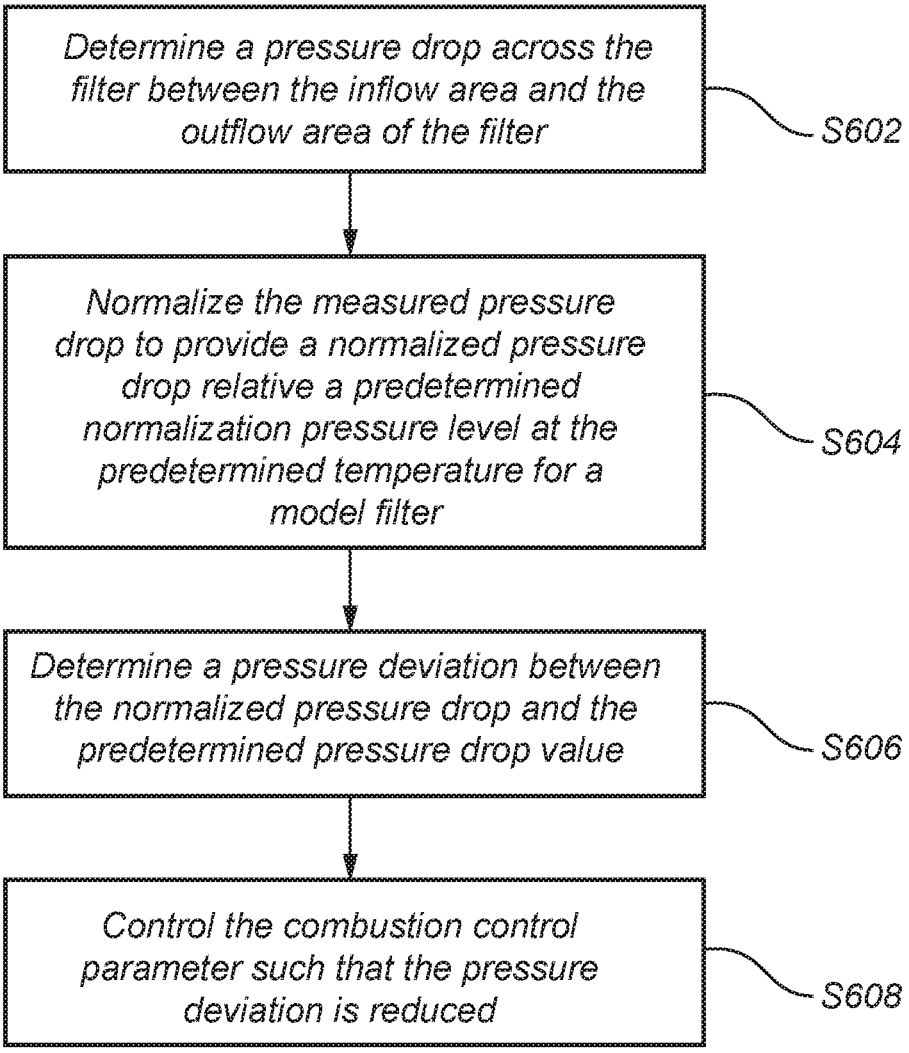
FIG. 7 is a flow-chart of method steps according to embodiments of the present disclosure.

FIG. 7 is a flow-chart of method steps according to example embodiments of the present disclosure. The method includes step S602 of determining a pressure drop across the filter between the inflow area and the outflow area of the filter. In step S604, normalizing the measured pressure drop to provide a normalized pressure drop relative a predetermined normalization pressure level at a predetermined temperature for a model filter. Step S606 includes determining a pressure deviation between the normalized pressure drop and the predetermined pressure drop value being calculated based on a pressure drop model including a relation between pressure drop and exhaust mass flow for a model filter, and the present exhaust gas flow. Accordingly, the normalized pressure drop may be compared to a pressure drop model comprising a relation between pressure drop and exhaust mass flow for a model filter. Step S608 includes controlling the combustion control parameter such that the pressure deviation is reduced. Thus, controlling the combustion control parameter to reduce the pressure deviation.

A first combustion control parameter may be controlled for increasing a present exhaust mass flow of combustion particulates, and second combustion control parameter may be controlled for reducing the pressure deviation.

There is further provided a control unit configured to control at least one combustion control parameter of an internal combustion engine, the at least one combustion control parameter can cause an increase in a present exhaust mass flow of combustion particulates into a particulate filter arranged to receive exhaust from the internal combustion engine, the control unit is further configured to: acquire pressure data from a pressure sensor arranged to measure the pressure drop across the filter, wherein the control unit is configured to, during a pre-conditioning process for the filter, control at least one combustion control parameter of the internal combustion engine to control the pressure drop across the filter to maintain a pressure deviation between a normalized pressure drop formed from the acquired pressure data relative a predetermined normalization pressure level for a model filter, and a predetermined pressure drop value, below a predetermined pressure deviation.

The control unit may be configured to determine a pressure drop across the filter between the inflow area and the outflow area of the filter, normalize the measured pressure drop to provide a normalized pressure drop value relative a predetermined normalization pressure level at a predetermined temperature for a model filter; determine a pressure deviation between the normalized pressure drop and the predetermined pressure drop value being calculated based on a pressure drop model including a relation between pressure drop and exhaust mass flow for a model filter, and the present exhaust gas flow; and control the combustion control parameter such that the pressure deviation is reduced.

In one aspect of the present disclosure there is provided a computer program product comprising a computer readable medium having stored thereon computer program means for controlling a conditioning process for a particulate filter for an aftertreatment system arranged downstream of an internal combustion engine, wherein the computer program product comprises: code for controlling at least one combustion control parameter of the internal combustion engine, to increase a present exhaust mass flow of combustion particulates into the filter, code for controlling at least one combustion control parameter of the internal combustion engine to control the pressure drop across the filter to maintain a pressure deviation between a normalized pressure drop formed from an acquired parameter indicative of a pressure drop across the filter relative a predetermined normalization pressure level for a model filter, and a predetermined pressure drop value, below a predetermined pressure deviation.

The communication between the control unit and other devices, systems, or components may be hardwired or may use other known electrical connection techniques, or wireless networks, known in the art such as via CAN-buses, Bluetooth, Wifi, Ethernet, 3G, 4G, 5G, etc.

A control unit may include a microprocessor, microcontroller, programmable digital signal processor or another programmable device, as well as be embedded into the vehicle/power train control logic/hardware. The control unit may also, or instead, include an application-specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device. The control unit may comprise modules in either hardware or software, or partially in hardware or software and communicate using known transmission buses such as CAN-bus and/or wireless communication capabilities.

A control unit of the present disclosure is generally known as an ECU, electronic control unit.

The person skilled in the art realizes that the present invention by no means is limited to the preferred embodiments described above. On the contrary, many modifications and variations are possible within the scope of the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. Any reference signs in the claims should not be construed as limiting the scope.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such non-transitory computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable gate arrays (FPGAs), complex programmable logic devices (CPLDs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements.

The invention claimed is:

1. A method for performing a conditioning process for a particulate filter arrangeable in an aftertreatment system downstream of an internal combustion engine, the method comprising:

controlling at least one combustion control parameter of the internal combustion engine to increase a present exhaust mass flow of combustion particulates into the filter, acquiring a parameter indicative of a pressure drop across the filter, and controlling at least one combustion control parameter of the internal combustion engine to control the pressure drop across the filter to maintain a pressure deviation between a normalized pressure drop, formed from the acquired parameter relative to a predetermined normalization pressure level for a model filter, and a predetermined pressure drop value, below a predetermined pressure deviation.

2. The method according to claim 1, wherein the combustion control parameter is controlled to increase a present flow of exhaust mass flow of combustion particulates into the filter while at the same time reducing the pressure deviation.

3. The method according to claim 1, wherein the combustion control parameter is controlled to maintain the pressure deviation within a pressure deviation range including the predetermined pressure deviation.

4. The method according to claim 1, wherein the combustion control parameter is controlled to reduce the pressure deviation.

5. The method according to claim 1, wherein the predetermined pressure drop value is based on a pressure drop model including a relation between pressure drop and exhaust mass flow for a model filter, and the present exhaust gas flow.

6. The method according to claim 1, comprising:

determining a pressure drop across the filter between the inflow area and the outflow area of the filter, normalizing the measured pressure drop to provide a normalized pressure drop relative a predetermined normalization pressure level at a predetermined temperature for a model filter, determining a pressure deviation between the normalized pressure drop and the predetermined pressure drop value being calculated based on a pressure drop model including a relation between pressure drop and exhaust mass flow for a model filter, and a present exhaust gas flow, and controlling the combustion control parameter such that the pressure deviation is reduced.

7. The method according to claim 6, wherein the normalized pressure drop is related to a normal operation pressure range.

8. The method according to claim 1, wherein the combustion control parameter includes at least one of the start positioning of the injection of the internal combustion engine and the air/fuel ratio for the internal combustion engine.

9. The method according to claim 1, wherein the particulate filter is a clean filter to be preconditioned.

10. The method according to claim 1, wherein the method steps are continuously repeated at a repetition rate.

11. The method according to claim 10, wherein the repetition rate substantially the same as the repetition rate for performing a lambda coefficient measurement of the exhaust gas.

12. The method according to claim 1, wherein when controlling the control parameter of the internal combustion engine to increase a present exhaust mass flow of combustion particulates into the filter, the at least one combustion control parameter of the internal combustion engine, is controlled in such a way that a present exhaust mass flow of combustion particulates into the filter is near or at a maximum level of particulates.

13. A control unit configured to control at least one combustion control parameter of an internal combustion engine, the at least one combustion control parameter can cause an increase in a present exhaust mass flow of combustion particulates into a particulate filter arranged to receive exhaust from the internal combustion engine, the control unit is further configured to:

acquire pressure data from a pressure sensor arranged to measure the pressure drop across the filter, wherein the control unit is configured to, during a pre-conditioning process for the filter, and control at least one combustion control parameter of the internal combustion engine to control the pressure drop across the filter to maintain a pressure deviation between a normalized pressure drop, formed from the acquired pressure data relative to a predetermined normalization pressure level for a model filter, and a predetermined pressure drop value, below a predetermined pressure deviation.

14. The control unit according to claim 13, wherein the control unit is configured to:

determine a pressure drop across the filter between the inflow area and the outflow area of the filter, normalize the measured pressure drop to provide a normalized pressure drop value relative a predetermined normalization pressure level at a predetermined temperature for a model filter, determine a pressure deviation between the normalized pressure drop and the predetermined pressure drop value being calculated based on a pressure drop model including a relation between pressure drop and exhaust mass flow for a model filter, and the present exhaust gas flow, and control the combustion control parameter such that the pressure deviation is reduced.

15. A computer product comprising a non-transitory computer readable medium having stored thereon instructions to be executed by a processor to control a conditioning process for a particulate filter for an aftertreatment system arranged downstream of an internal combustion engine, wherein the instructions comprise:

controlling at least one combustion control parameter of the internal combustion engine, in such a way that a present exhaust mass flow of combustion particulates into the filter is increased, and controlling the at least one combustion control parameter to maintain a pressure deviation between a normalized pressure drop, formed from an acquired pressure data relative to a predetermined normalization pressure level for a model filter, and a predetermined pressure drop value, below a predetermined pressure deviation.

* * * * *